US010607552B2

(12) United States Patent
Roever

(10) Patent No.: US 10,607,552 B2
(45) Date of Patent: Mar. 31, 2020

(54) PARALLEL PIPELINES FOR COMPUTING BACKLIGHT ILLUMINATION FIELDS IN HIGH DYNAMIC RANGE DISPLAY DEVICES

(71) Applicant: NVIDIA Corporation, Santa Clara, CA (US)

(72) Inventor: Jens Roever, Los Gatos, CA (US)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 16/152,358

(22) Filed: Oct. 4, 2018

(65) Prior Publication Data

US 2019/0266954 A1 Aug. 29, 2019

Related U.S. Application Data

(60) Provisional application No. 62/636,129, filed on Feb. 27, 2018.

(51) Int. Cl.

| | |
|---|---|
| ***G09G 5/02*** | (2006.01) |
| ***G09G 3/34*** | (2006.01) |
| ***G09G 3/20*** | (2006.01) |
| ***G09G 3/36*** | (2006.01) |

(52) U.S. Cl.

CPC ..... *G09G 3/342* (2013.01); *G09G 3/2096* (2013.01); *G09G 3/36* (2013.01); *G09G 2320/0252* (2013.01); *G09G 2320/0646* (2013.01); *G09G 2360/141* (2013.01); *G09G 2360/145* (2013.01); *G09G 2360/16* (2013.01)

(58) Field of Classification Search

CPC ..... G09G 3/34; G09G 3/342; G09G 3/3426; G09G 2320/0646; G09G 2360/141; G09G 2360/145; G09G 2360/16

See application file for complete search history.

(56) References Cited

U.S. PATENT DOCUMENTS

| | | | | |
|---|---|---|---|---|
| 6,359,662 | B1 | 3/2002 | Walker | |
| 7,843,402 | B2 * | 11/2010 | Nakadaira | G02B 27/2278 345/6 |
| 8,059,070 | B2 * | 11/2011 | Odawara | G09G 3/3233 345/76 |
| 2006/0279522 | A1 * | 12/2006 | Kurihara | G09G 3/3413 345/102 |
| 2010/0171690 | A1 | 7/2010 | Park et al. | |

(Continued)

OTHER PUBLICATIONS

Non-Final Office Action received for U.S. Appl. No. 16/163,516 dated Nov. 19, 2019, 22 pages.

*Primary Examiner* — Joe H Cheng

(74) *Attorney, Agent, or Firm* — Artegis Law Group, LLP

(57) ABSTRACT

A display controller generates a backlight illumination field (BLIF) based on a coarse point-spread function (PSF) and a correction PSF. The display controller samples the coarse PSF to accumulate light contributions from a larger neighborhood of LEDs around a given LCD pixel. The display controller samples the correction PSF to generate correction factors for a smaller neighborhood of LEDs around the given LCD pixel. The display controller interpolates samples drawn from the coarse PSF and samples drawn from the correction PSF and then combines the interpolated samples to generate a full resolution BLIF.

20 Claims, 13 Drawing Sheets

(56) References Cited

U.S. PATENT DOCUMENTS

| | | | | |
|---|---|---|---|---|
| 2010/0225574 | A1* | 9/2010 | Fujiwara | G09G 3/3426 345/102 |
| 2011/0050760 | A1* | 3/2011 | Ito | G09G 3/3426 345/694 |
| 2011/0122170 | A1 | 5/2011 | Kim et al. | |
| 2011/0141077 | A1* | 6/2011 | Cho | G09G 3/3426 345/207 |
| 2012/0105509 | A1* | 5/2012 | Ito | G02F 1/133603 345/690 |
| 2012/0154459 | A1* | 6/2012 | Otoi | G09G 3/3426 345/690 |
| 2013/0010016 | A1* | 1/2013 | Sasaki | G09G 3/20 345/690 |
| 2013/0314459 | A1* | 11/2013 | Nakanishi | G09G 3/3406 345/694 |
| 2015/0070403 | A1* | 3/2015 | Kim | G09G 3/3607 345/690 |
| 2016/0225301 | A1 | 8/2016 | Scepanovic et al. | |
| 2016/0344992 | A1 | 11/2016 | D'Alfonso et al. | |
| 2018/0277059 | A1* | 9/2018 | Tomabechi | G09G 5/10 |
| 2018/0336397 | A1 | 11/2018 | Smith | |
| 2019/0107626 | A1* | 4/2019 | Matsuura | G01B 11/026 |
| 2019/0188917 | A1* | 6/2019 | Cho | G06T 19/006 |
| 2019/0266935 | A1* | 8/2019 | Roever | G09G 3/2051 |
| 2019/0266959 | A1* | 8/2019 | Slavenburg | G09G 3/3413 |
| 2019/0266961 | A1* | 8/2019 | Slavenburg | G09G 3/3426 |

* cited by examiner

PARALLEL PIPELINES FOR COMPUTING BACKLIGHT ILLUMINATION FIELDS IN HIGH DYNAMIC RANGE DISPLAY DEVICES

CROSS-REFERENCE TO RELATED APPLICATIONS

This application claims the priority benefit of the U.S. provisional patent application titled, "Backlight Illumination Field Computation Pipeline for HDR Displays," filed on Feb. 27, 2018 and having the Ser. No. 62/636,129. The subject matter of this related application is hereby incorporated herein by reference.

BACKGROUND

Field of the Various Embodiments

Embodiments of the present invention relate generally to display devices and display technology and, more specifically, to parallel pipelines for computing backlight illumination fields in high dynamic range display devices.

Description of the Related Art

A conventional liquid-crystal display (LCD) usually includes an array of light-emitting diodes (LEDs) coupled to an array of LCD pixels. The array of LEDs is commonly known as the "backlight." In operation, the backlight emits light to the array of LCD pixels with a brightness that can vary across different LCD pixels. A given LCD pixel includes a set of filters that modifies the color of the light received from the backlight in order to emit light having a specific color value.

In a typical system, a display controller coordinates the operations of the backlight and the array of LCD pixels to cause an image to be displayed via the LCD. In so doing, the display controller determines the brightness of each LED included in the backlight based on the image to be displayed and then sets the current supplied to each LED to achieve the determined brightness. The display controller also configures each LCD pixel to emit light having a color value that represents a specific portion or pixel of the image being displayed. To configure a given LCD pixel to emit light having a specific color value, the display controller first estimates the total intensity of light received at the given LCD pixel from some or all LEDs included in the backlight. The display controller then divides the desired color value by that total intensity to produce percentages of red, green, and blue light the given LCD pixel should filter when displaying the image. Finally, the display controller configures the given LCD pixel according to these percentages.

When performing the above operations, the display controller usually estimates the total intensity of light received at a given LCD pixel by accumulating the individual light contributions from each LED to the given LCD pixel. Based on the accumulated light contributions, the display controller generates an entry in a backlight illumination field (BLIF) corresponding to the given LCD pixel. The light contribution from any given LED to a given LCD pixel can be estimated by evaluating a point-spread function (PSF). A PSF is a mapping that indicates the intensity of light at different distances from an LED. When computing an entry in the BLIF for a given LCD pixel, the display controller evaluates the PSF across all LEDs that contribute light to the given LCD pixel and then accumulates the results of those evaluations. The display controller performs these steps across all LCD pixels to fully populate the BLIF with a different entry for each LCD pixel. The display controller typically generates a new BLIF each time the LCD refreshes. Notably, this approach for generating BLIFs, is not feasible for certain types of display devices.

In particular, for high resolution display devices with densely populated backlights that operate at high refresh rates, the above computations have to be performed an excessive number of times in order to configure each LCD pixel. For example, in a 4K high dynamic range (HDR) display with a 24×16 matrix backlight operating at a 1440 Hz refresh rate, the display controller would need to evaluate the PSF approximately 300 billion times per second. Conventional display controllers simply do not operate not fast enough to complete all of the necessary computations and still maintain appropriate refresh rates. Consequently, conventional display controllers oftentimes make tradeoffs between computational accuracy and refresh rate when generating BLIFs for high resolution display devices. However, in specific high performance applications, such as gaming applications, sacrificing either computational accuracy or refresh rate can diminish the overall user experience.

As the foregoing illustrates, what is needed in the art are more effective techniques for computing BLIFs when configuring LCD pixels to display images.

SUMMARY

Various embodiments include a computer-implemented method for displaying an image, including generating a first sample associated with a first light source based on a first dataset, where the first dataset includes a first plurality of luminance values indexed by a first set of distances, generating a second sample associated with the first light source based on a second dataset, where the second dataset includes a second plurality of luminance values indexed by a second set of distances, combining the first sample with the second sample to determine a first luminance value associated with light that is contributed to a first screen pixel by the first light source, and configuring the first screen pixel to output light associated with a first portion of the image based on the first luminance value.

At least one technological advantage of the disclosed techniques is that the display controller generates a full resolution BLIF with high accuracy and with far fewer computations compared to conventional approaches.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one skilled in the art that the inventive concepts may be practiced without one or more of these specific details.

As noted above, a conventional display controller performs a lengthy series of complex computations in order to compute a backlight illumination field (BLIF) when configuring LCD pixels to display an image. In particular, the display controller evaluates a PSF for each LCD pixel across all LEDs and then accumulates the results to produce a single entry in the BLIF. The display controller repeats these steps across all LCD pixels to fully populate the BLIF. The display controller generates a new BLIF each time the display device refreshes. With high resolution display devices having densely populated backlights, the number of computations needed to generate a BLIF can become excessive. Conventional display controllers do not operate with sufficient speed to generate BLIFs at very high refresh rates. Consequently, conventional display controllers cannot be implemented in display devices designed for gaming or other high performance applications that demand very high refresh rates.

To address these issues, embodiments of the invention include a display controller that generates a BLIF based on a coarse PSF and a correction PSF. The display controller samples the coarse PSF to accumulate light contributions from a larger neighborhood of LEDs around a given LCD pixel. The display controller samples the correction PSF to generate correction factors for a smaller neighborhood of LEDs around the given LCD pixel. The display controller interpolates samples drawn from the coarse PSF and samples drawn from the correction PSF and then combines the interpolated samples to generate a full resolution BLIF.

At least one technological advantage of the disclosed techniques is that the display controller generates a full resolution BLIF with high accuracy and with far fewer computations compared to conventional approaches. Because fewer computations are needed, the disclosed display controller can generate BLIFs much faster than conventional display controllers. The disclosed display controller can therefore support high resolution display devices that include densely populated backlights and operate with high refresh rates. Accordingly, the disclosed display controller is especially useful for display devices designed for gaming and other high performance applications. For these reasons, the disclosed techniques represent a significant technological advancement compared to previous approaches.

System Overview

Figure 1:
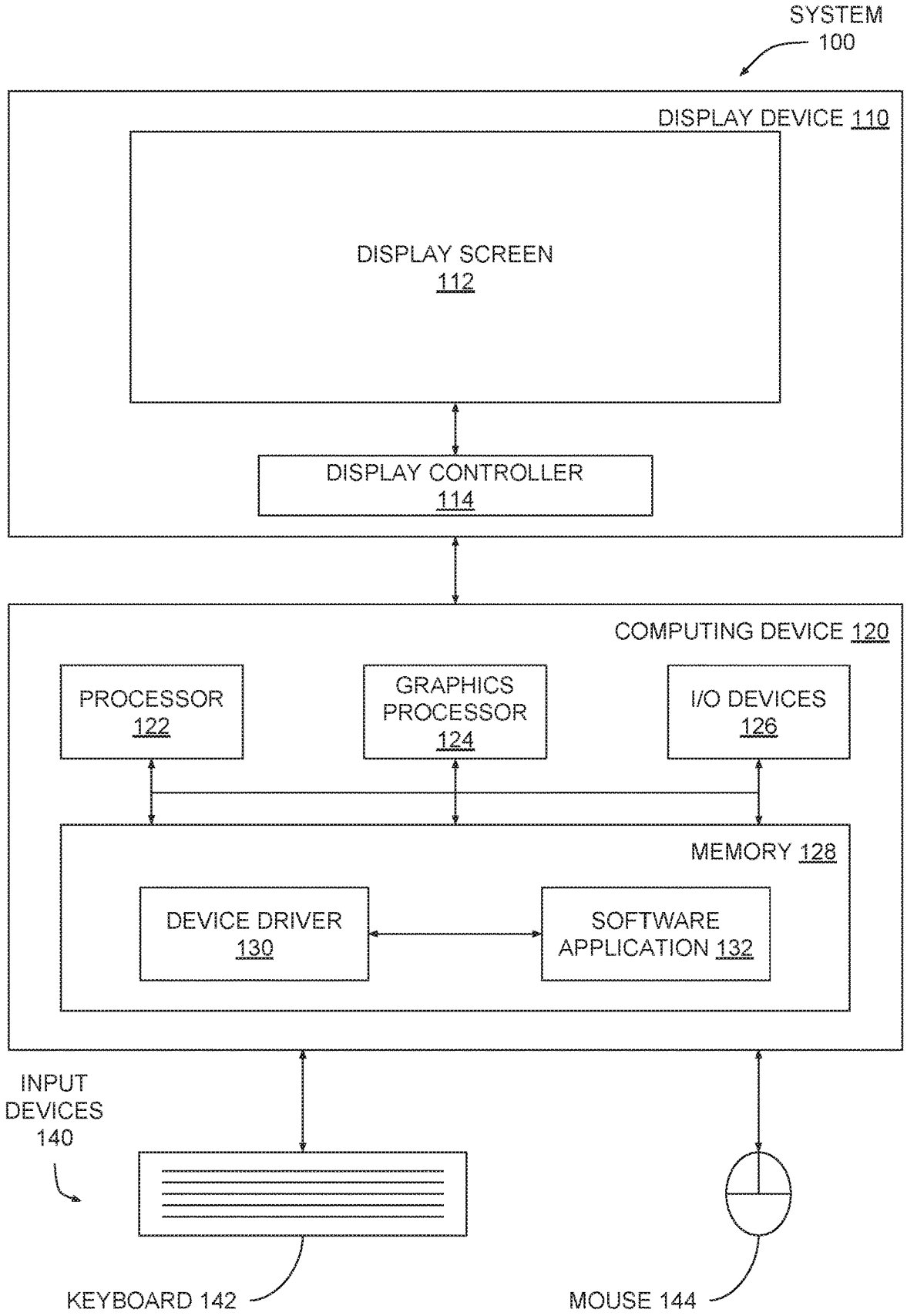
FIG. 1 illustrates a system configured to implement one or more aspects of the present invention.

FIG. 1 illustrates a system configured to implement one or more aspects of the present invention. As shown, system 100 includes a display device 110 coupled to a computing device 120. Computing device 120 is coupled to input devices 140 that include a keyboard 142 and a mouse 144. Display device 110 includes a display screen 112 and a display controller 114. In one embodiment, display device 110 is an LCD with an LED backlight configured for high dynamic range (HDR) output.

Computing device 120 includes a processor 122, a graphics processor 124, input/output (I/O) devices 126, and memory 128, coupled together. Processor 122 includes any technically feasible set of hardware units configured to process data and execute software applications. For example, processor 122 could include one or more central processing units (CPUs). Graphics processor 124 includes any technically feasible set of hardware units configured to process graphics data and execute graphics applications. For example, graphics processor 124 could include one or more graphics processing units (GPUs). I/O devices 126 include any technically feasible set of devices configured to perform input and/or output operations, including, for example, a universal serial bus (USB) port, among others. Memory 128 includes any technically feasible storage media configured to store data and software applications, such as, for example, a hard disk and/or a random-access memory (RAM) module, among others. Memory 128 includes a device driver 130 and a software application 132.

Device driver 130 includes program code that is executed by processor 122 to coordinate the operation of graphics processor 124. During execution, device driver 130 acts as an interface to graphics processor 124. Software application 132 includes program code that is executed by processor 122 to generate graphics processing tasks to be performed by graphics processor 124. In operation, software application 132 transmits these graphics processing tasks to device driver 130, and device driver 130 generates machine code that can be executed by graphics processor 124 to perform the graphics processing tasks. The graphics processing tasks could include, for example, graphics rendering operations, encoding operations, decoding operations, and so forth.

When performing graphics rendering operations, graphics processor 124 generates images on behalf of software application 132 and then causes display device 110 to display those images. For example, software application 132 could be a video game that leverages graphics processor 124 to render images depicting a simulating environment. Display device 110 could display these images to the user via display screen 112. Display screen 112 is described in greater detail below in conjunction with FIG. 2.

Figure 2:
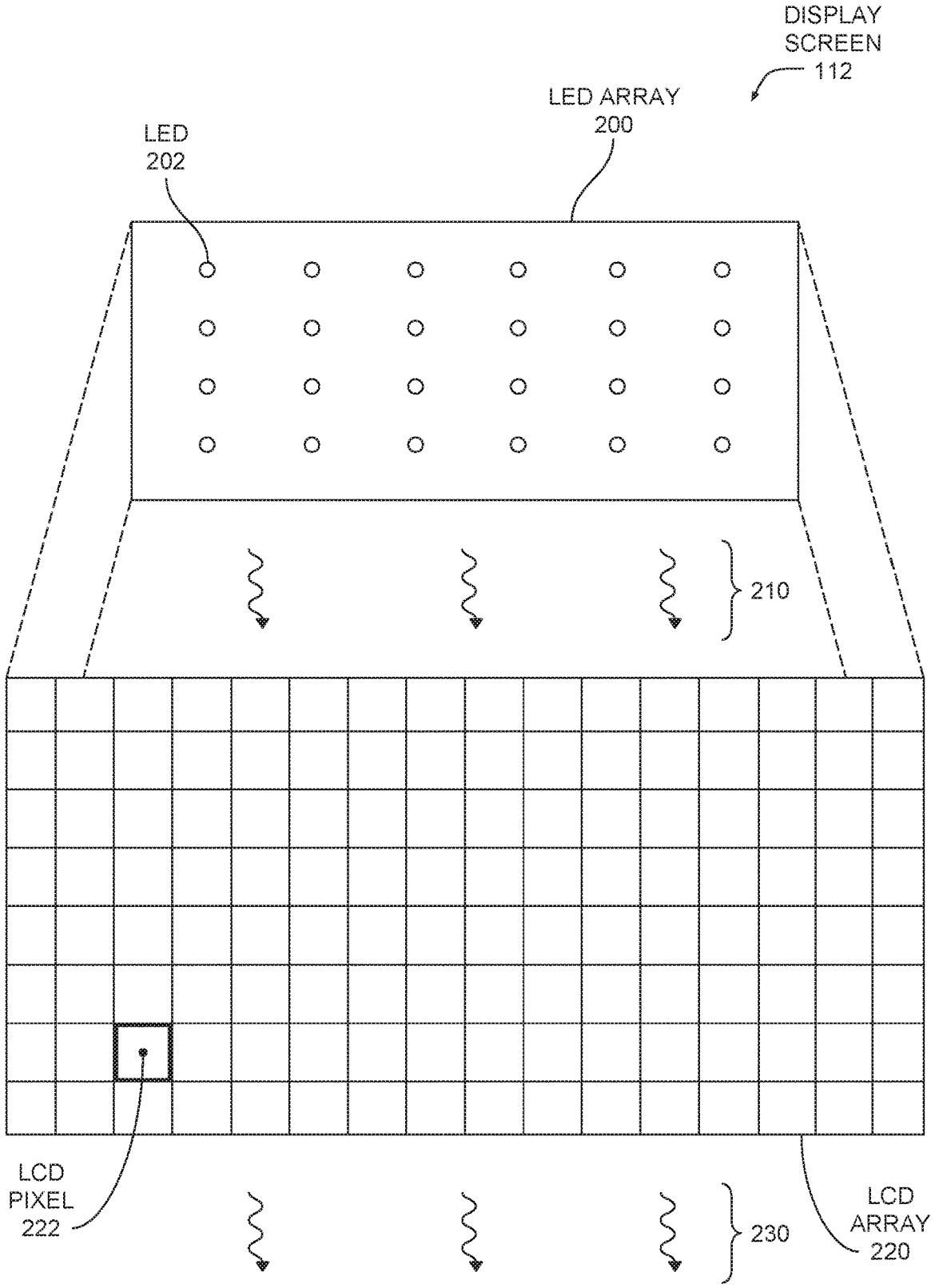
FIG. 2 is a more detailed illustration of the display screen of FIG. 1, according to various embodiments of the present invention.

FIG. 2 is a more detailed illustration of the display screen of FIG. 1, according to various embodiments of the present invention. As shown, display screen 112 includes an LED array 200 that includes a plurality of LEDs 202. LED array 200 may be known in the art as a "backlight." Display screen 112 also includes an LCD array 220 that includes a plurality of LCD pixels 222. LED array 200 is coupled to LCD array 220 and configured to emit light 210 to illuminate LCD array 220. LCD pixels 222 are at least partially translucent and therefore allow the re-transmission of any received light. Each LCD pixel 222 can be configured to filter the red, green, and blue (RGB) color components of light 210 and to then emit light 230 with a desired RGB color value. The operation of an exemplary LCD pixel 222 is described in greater detail below in conjunction with FIG. 3.

Figure 3:
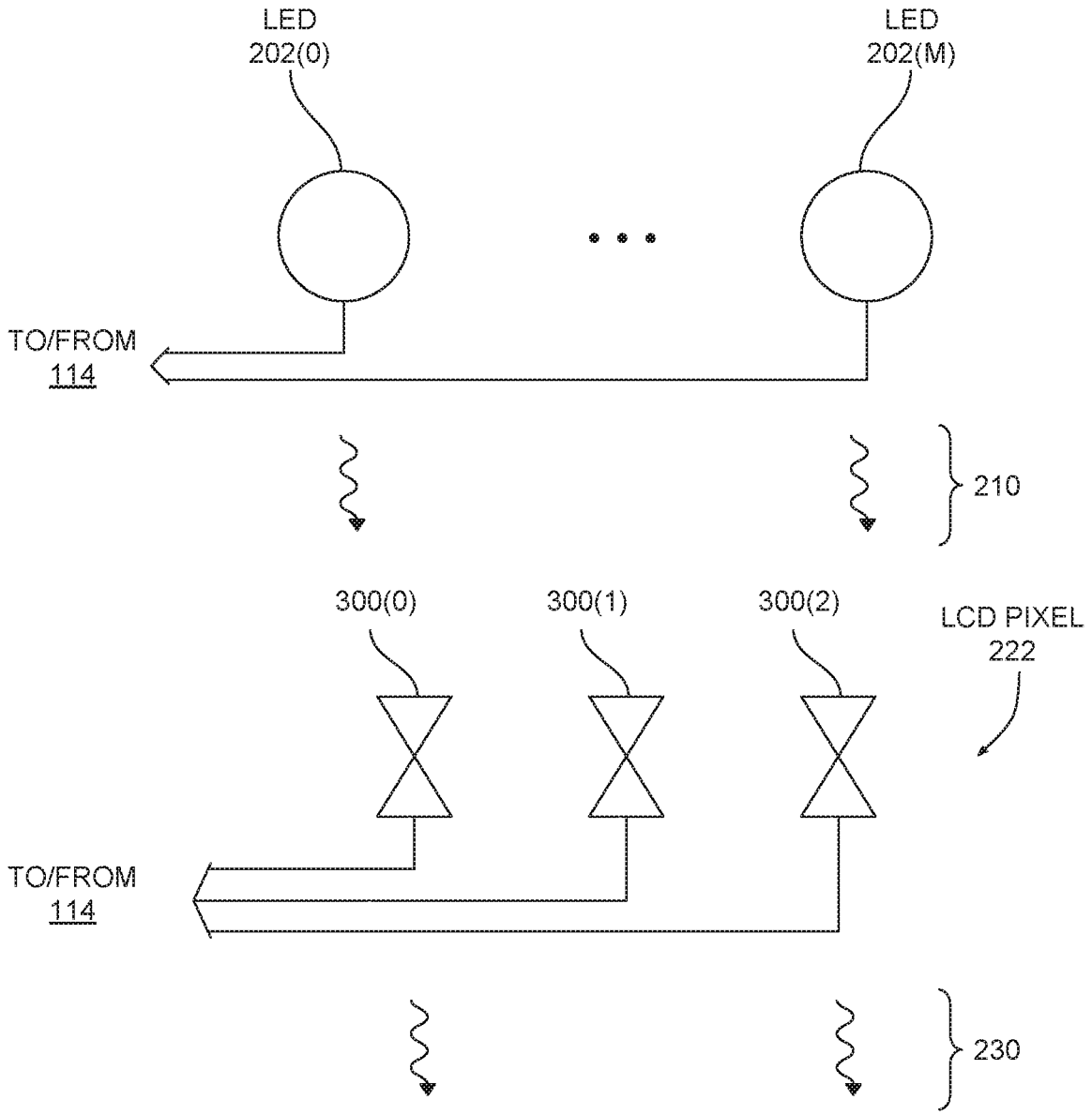
FIG. 3 is a more detailed illustration of one of the LCD pixels of FIG. 2, according to various embodiments of the present invention.

FIG. 3 is a more detailed illustration of an LCD pixel of FIG. 2, according to various embodiments of the present invention. As shown, an LCD pixel 222 includes valves 300(0), 300(1), and 300(2). A given valve 300 controls the amount of red, green, or blue light that is filtered by LCD pixel 222. In particular, valve 300(0) controls the filtering of red light, valve 300(1) controls the filtering of green light, and valve 300(2) controls the filtering of blue light. LCD pixel 222 receives light 210 from LEDs 202(0) through 202(M). LEDs 202(0) through 202(M) include some or all LEDs included in LED array 200. Based on the settings of valves 300, LCD pixel 222 filters light 210 and then outputs light 230 having a specific red, green, blue (RGB) color value.

Display controller 114 controls the brightness of LEDs 202 by supplying varying levels of current to each LED 202. For example, display controller 114 could cause an LED 202 to output light with an elevated brightness by supplying an elevated current level to that LED. Display controller 114 controls the color of light emitted by LCD pixel 222 by setting different percentages with which valves 300 should filter red, green, and blue light. For example, display controller 114 could cause LCD pixel 222 to output a purely blue light by setting valves 300(0) and 300(1) to filter 100% of red light and 100% of green light and filter 0% of blue light, thereby allowing only the blue component of light 210 to pass through LCD pixel 222 relatively unfiltered. As a general matter, display controller 114 controls the operation of LEDs 202 and LCD pixels 222 based on the image to be displayed, as described in greater detail below in conjunction with FIG. 4.

Figure 4:
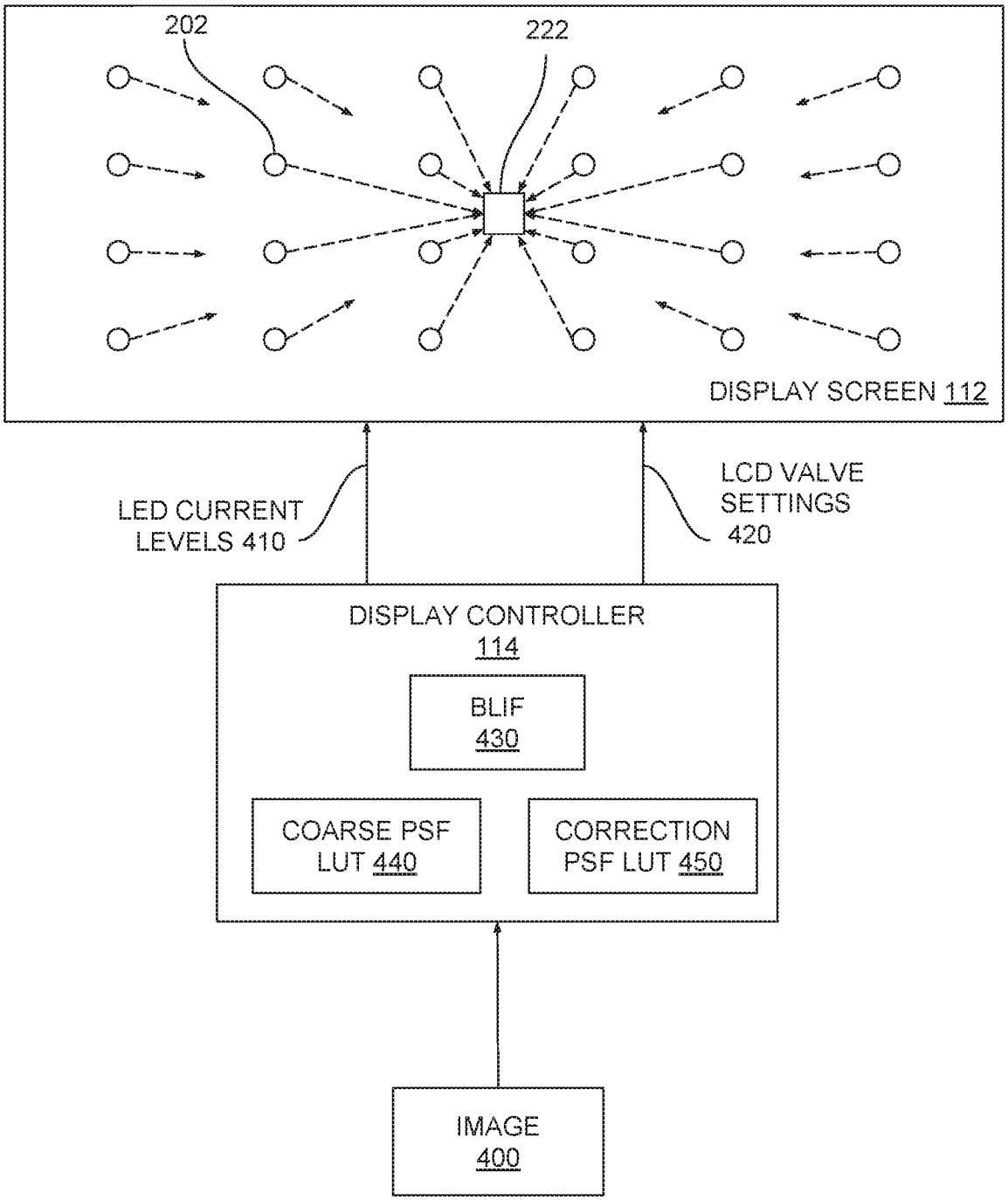
FIG. 4 illustrates how the display controller of FIG. 1 causes an image to be displayed, according to various embodiments of the present invention.

FIG. 4 illustrates how the display controller of FIG. 1 causes an image to be displayed, according to various embodiments of the present invention. As shown, display controller 114 receives an image 400 and then generates LED current levels 410 and LCD valve settings 420. When generating LED current levels 410, display controller 114 performs an image processing operation with image 400 to determine a target brightness for each LED 202. Display controller 114 then determines the specific current level that should be supplied to each LED 202 to achieve the target brightness. When LEDs 202 are illuminated according to a given brightness setting, each LED 202 outputs light with a specific intensity, or luminance. Each LED 202 contributes a certain amount of this luminance to each LCD pixel 222. As is shown, LED 202 generates a luminance contribution 402 that is received by LCD pixel 222.

When generating LCD valve settings 420 for image 400, display controller 114 maps each LCD pixel 222 to a different portion or pixel of image 400 to determine a target RGB color value for each LCD pixel 222. Display controller 114 also accumulates luminance contributions 402 provided by some or all LEDs 202 to each LCD pixel 222 to generate a backlight illumination field (BLIF) 430. BLIF 430 is an array of values that indicates the total luminance received at each LCD pixel 222 when some or all LEDs 202 emit light based on the target brightness settings. Display controller 114 determines LCD valve settings 420 for LCD pixels 222 by dividing the target RGB color values by corresponding values included in BLIF 430.

Display controller 114 generates BLIF 430 for image 400 by approximating a point-spread function (PSF). The PSF indicates the luminance of light emitted by an LED 202 at different distances from the LED 202. Luminance generally decreases over distance. Accordingly, PSF can be visualized as a bell-shaped curve centered at the position of the LED 202. The luminance contributed by a given LED 202 to a given LCD pixel 222 can be estimated by evaluating the PSF based on the distance between the given LED 202 and the given LCD pixel 222. The total luminance contributed by multiple LEDs 202 to the given LCD pixel 222 can be estimated by accumulating the results of multiple PSF evaluations across multiple LEDs 202. In operation, display controller 114 approximates the PSF via a coarse PSF look-up table (LUT) 440 and correction PSF LUT 450. Each of these LUTs includes a set of luminance values or luminance difference values indexed by distance. Display controller 114 generates highly accurate approximations to the PSF based on coarse PSF LUT 440 and correction PSF LUT 450, as described in greater detail below in conjunction with FIGS. 5A-5D.

Generating a BLIF via Superposition of PSF Samples

Figure 5A:
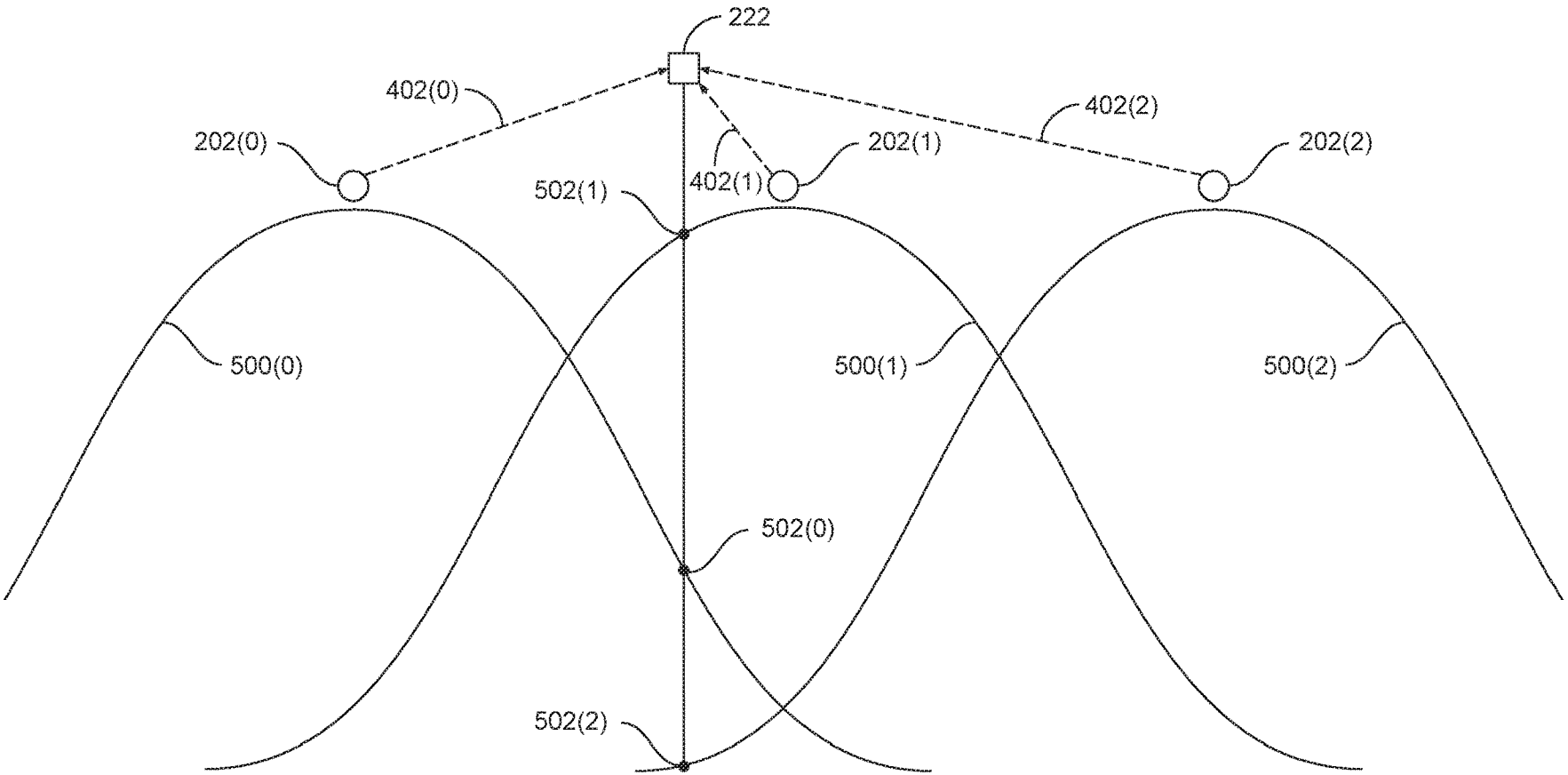
FIGS. 5A-5E illustrate how the display controller of FIG. 1 approximates a point-spread function when generating a backlight illumination field, according to various embodiments of the present invention.
Figure 5B:
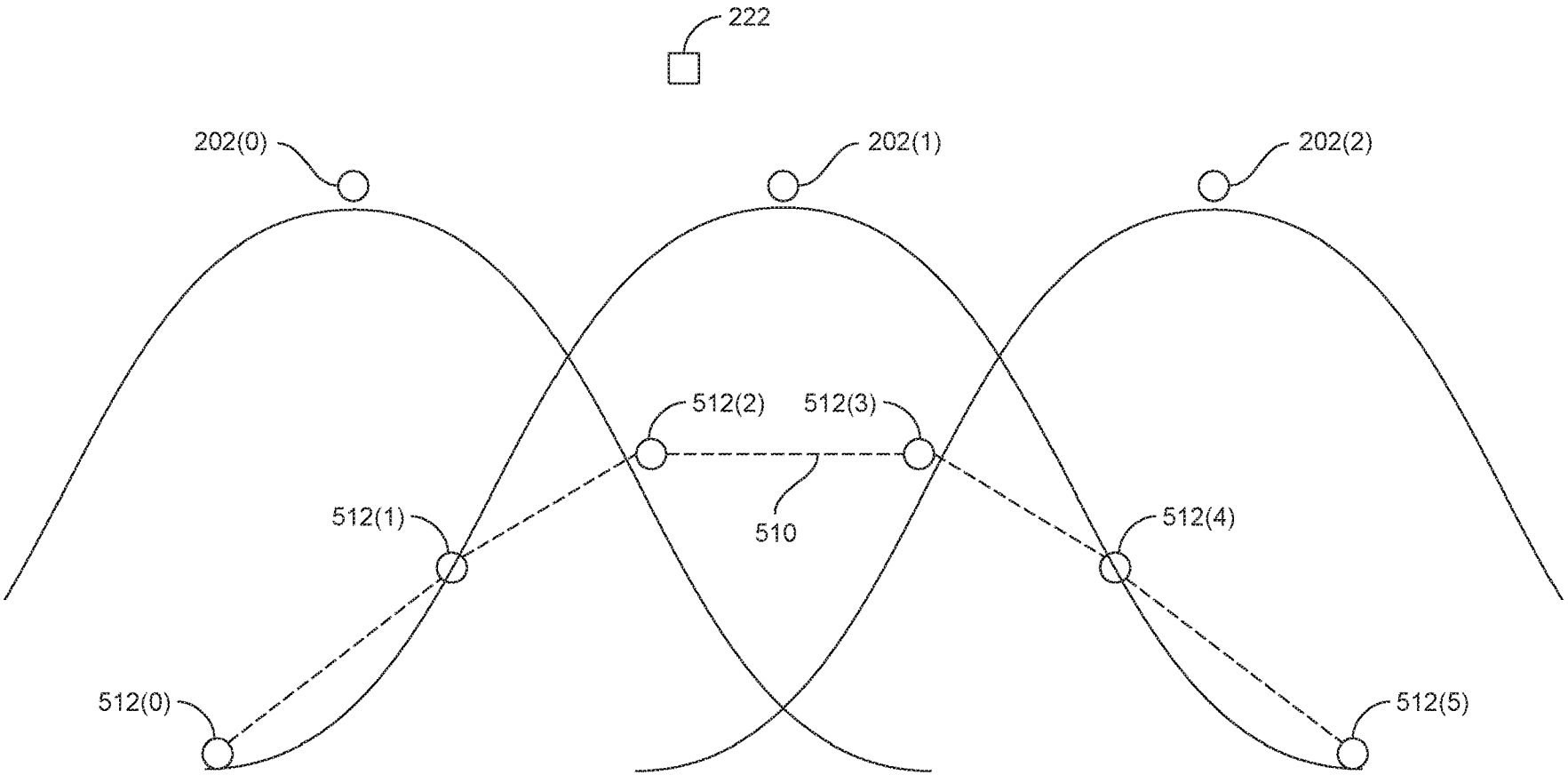

FIGS. 5A-5B illustrate how the display controller of FIG. 1 approximates a point-spread function when generating a backlight illumination field, according to various embodiments of the present invention.

As shown in FIG. 5A, LEDs 202(0), 202(1), and 202(2) are arranged horizontally and configured provide luminance contributions 402(0), 402(1), and 402(2), respectively, to LCD pixel 222. As also shown, LEDs 202(0), 202(1), and 202(2) are associated with PSFs 500(0), 500(1), and 500(2), respectively. Each PSF 500 is an idealized curve that is presented here for illustrative purposes only in order to describe how PSFs can be evaluated to accumulate luminance contributions. Generally, a PSF indicates the luminance contributed by a light source, such as an LED, as a function of distance away from the light source. The PSF 500 associated with a given LED 202 can be evaluated based on the distance between the given LED 202 and LCD pixel 222 to determine a contribution value 502 for the associated luminance contribution 402.

For example, PSF 500(0) could be evaluated based on the distance between LED 202(0) and LCD pixel 222 to generate contribution value 502(0). Similarly, PSF 500(1) could be evaluated based on the distance between LED 202(1) and LCD pixel 222 to generate contribution value 502(1), and PSF 500(2) could be evaluated based on the distance between LED 202(2) and LCD pixel 222 to generate contribution value 502(2). These contribution values 502 can be scaled based on the brightness settings of LEDs 202 and then accumulated to determine the total luminance received at LCD pixel 222. For example, contribution values 502(0), 502(1), and 502(2) could be scaled according to the brightness settings of LEDs 202(0), 202(1), and 202(2), respectively, and the results of this scaling could then be accumulated to determine the total luminance received at LCD pixel 222 from LEDs 202. This total luminance represents a BLIF value corresponding to LCD pixel 222.

Display controller 114 does not directly perform the above computations with PSFs 500, however. Again, PSFs 500 are idealized curves presented here for illustrative purposes. Instead, display controller 114 implements coarse PSF LUT 440 and correction PSF LUT 450, as mentioned above in conjunction with FIG. 4. Coarse PSF LUT 440 includes relatively sparse samples of PSF 500, while correction PSF LUT 450 includes relatively dense correction factors. Display controller 114 constructs a coarse approximation of PSF 500 based on coarse PSF LUT 440 via the techniques described below in conjunction with FIG. 5B.

As shown in FIG. 5B, a coarse curve 510 includes samples 512(0), 512(1), 512(2), 512(3), 512(4), and 512(5). Coarse curve 510 is a coarse approximation of PSF 500(1) associated with LED 202(1). In one embodiment, coarse curve 510 need not accurately track PSF 500(1) across specific regions, because corrections are subsequently applied to specific regions of coarse curve 510, as described in greater detail below in conjunction with FIGS. 5C-5D, Display controller 114 generates coarse curve 510 by extracting samples 512 from coarse PSF LUT 440 based on the distance between LED 202(1) and LCD pixel 222. PSF LUT 440 includes samples of luminance values that are indexed based on a first set of distances, where the resolution of those distances depends on the resolution of the associated samples. A given sample included in coarse PSF LUT 440 is generated based on an arbitrary LED 202 that is configured with a baseline brightness setting.

Display controller 114 scales samples 512 from this baseline brightness setting relative to the actual brightness setting of LED 202(1). Display controller 114 then performs a linear interpolation between samples 512 to generate coarse curve 510. Coarse curve 510 models PSF 500(1) with reasonable accuracy towards the outer fringes of PSF 500(1) where curvature is low. However, towards the center of PSF 500(1), coarse curve 510 is relatively inaccurate because curvature is higher. Display controller 114 corrects for these inaccuracies using correction PSF LUT 450, as described below in conjunction with FIG. 5C.

Figure 5C:
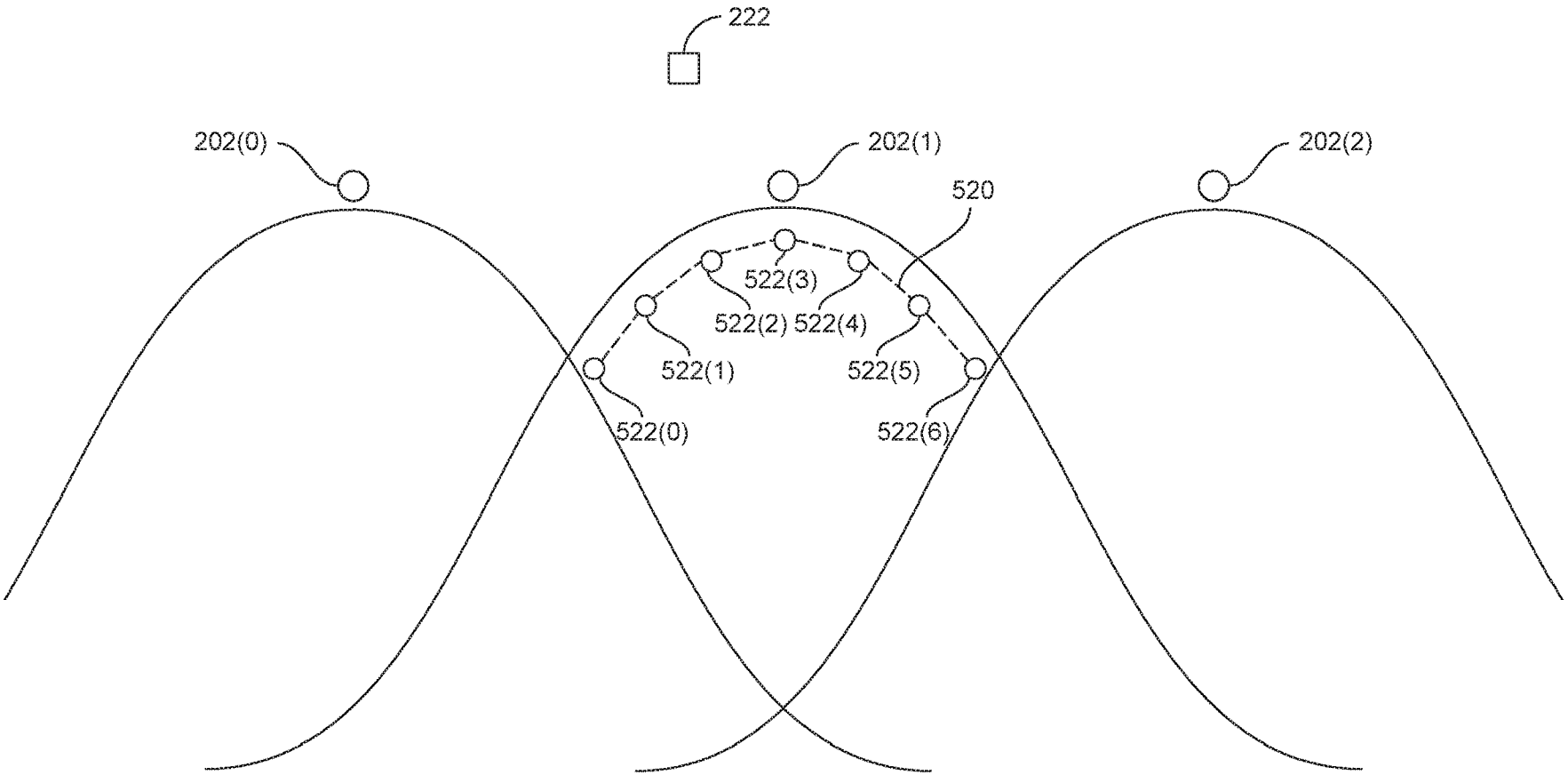

As shown in FIG. 5C, correction curve 520 includes samples 522(0), 522(1), 522(2), 522(3), 522(4), 522(5), and 522(6). Correction curve 520 approximates the difference between coarse curve 510 described above and PSF 500(1). Display controller 114 generates correction curve 520 by extracting samples 522 from correction PSF LUT 450 based on the distance between LED 202(1) and LCD pixel 222.

Correction PSF LUT 450 includes samples of luminance difference values that are indexed based on a second set of distances, where the resolution of those distances depends on the resolution of the associated samples. A given sample included in correction PSF LUT 450 is generated based on the difference between samples included in coarse PSF LUT 440 and corresponding values of PSF 500.

Similar to samples 510 of PSF LUT 440, samples 522 of correction PSF LUT 450 are defined relative to a baseline LED brightness setting. Accordingly, display controller 114 scales samples 522 relative to the configured brightness setting of LED 202(1). Display controller 114 then performs a linear interpolation between samples 522 to generate correction curve 520. Correction curve 520 models PSF 500(1) with high accuracy towards the center of PSF 500(1) where curvature is high but does not model PSF 500(1) accurately (or at all) towards the outer fringes of PSF 500(1). Display controller 114 combines a portion of coarse curve 510 with a portion of correction curve 520 to generate a highly accurate approximate sample of PSF 500, as described below in conjunction with FIG. 5D.

Figure 5D:
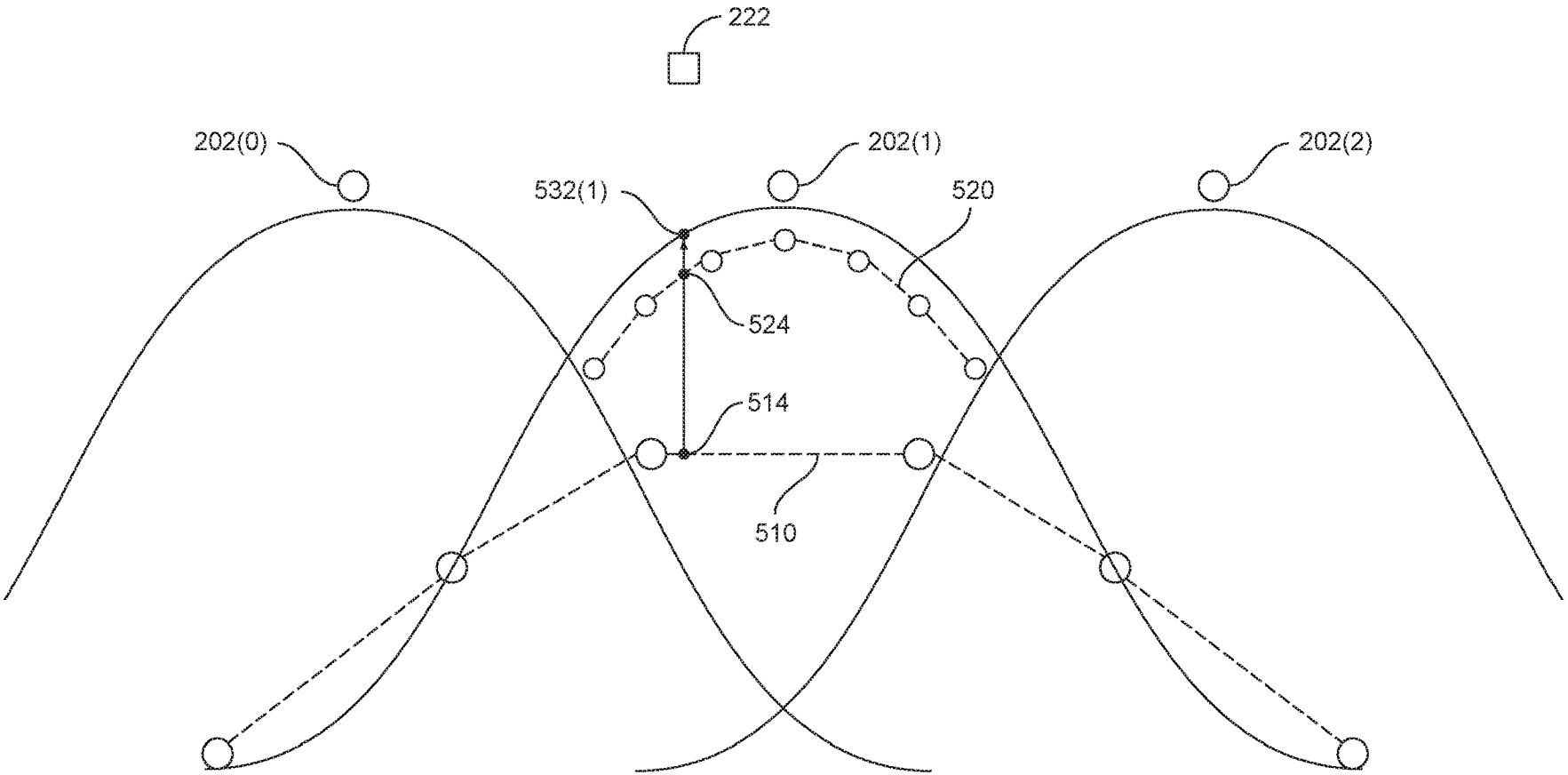

As shown in FIG. 5D, display controller 114 generates interpolated sample 514 along coarse curve 510 based on an interpolation between samples 512(2) and 512(3). Display controller 114 also generates interpolated sample 524 along correction curve 520 based on an interpolation between samples 522(1) and 522(2). Display controller 114 combines interpolated sample 514 with interpolated sample 524 to generate approximate contribution 532(1). Approximate contribution 532(1) is a high precision estimate of contribution value 502(1) derived from PSF 500(1).

Because display controller 114 combines specific portions of coarse curve 510 and correction curve 520 in the manner described, neither coarse curve 510 nor correction curve 520 necessarily need to track the contour of PSF 500(1) or align with actual sub-sampled locations of PSF 500(1). As a general matter, because display controller 114 applies corrections to coarse curve 510, coarse curve 510 can have a multitude of shapes and/or values in regions where display controller 114 applies those corrections. For example, interpolated sample 514 could lie above PSF 500(1), and interpolated sample 524 could be a negative value that reduces interpolated sample 514 when combined with interpolated sample 514. Display controller 114 repeats the techniques described above relative to LED 202(1) to approximate PSFs 500(0) and 500(2) and generate corresponding estimates of contribution values 502(0) and 502(1), as described below in conjunction with FIG. 5E.

Figure 5E:
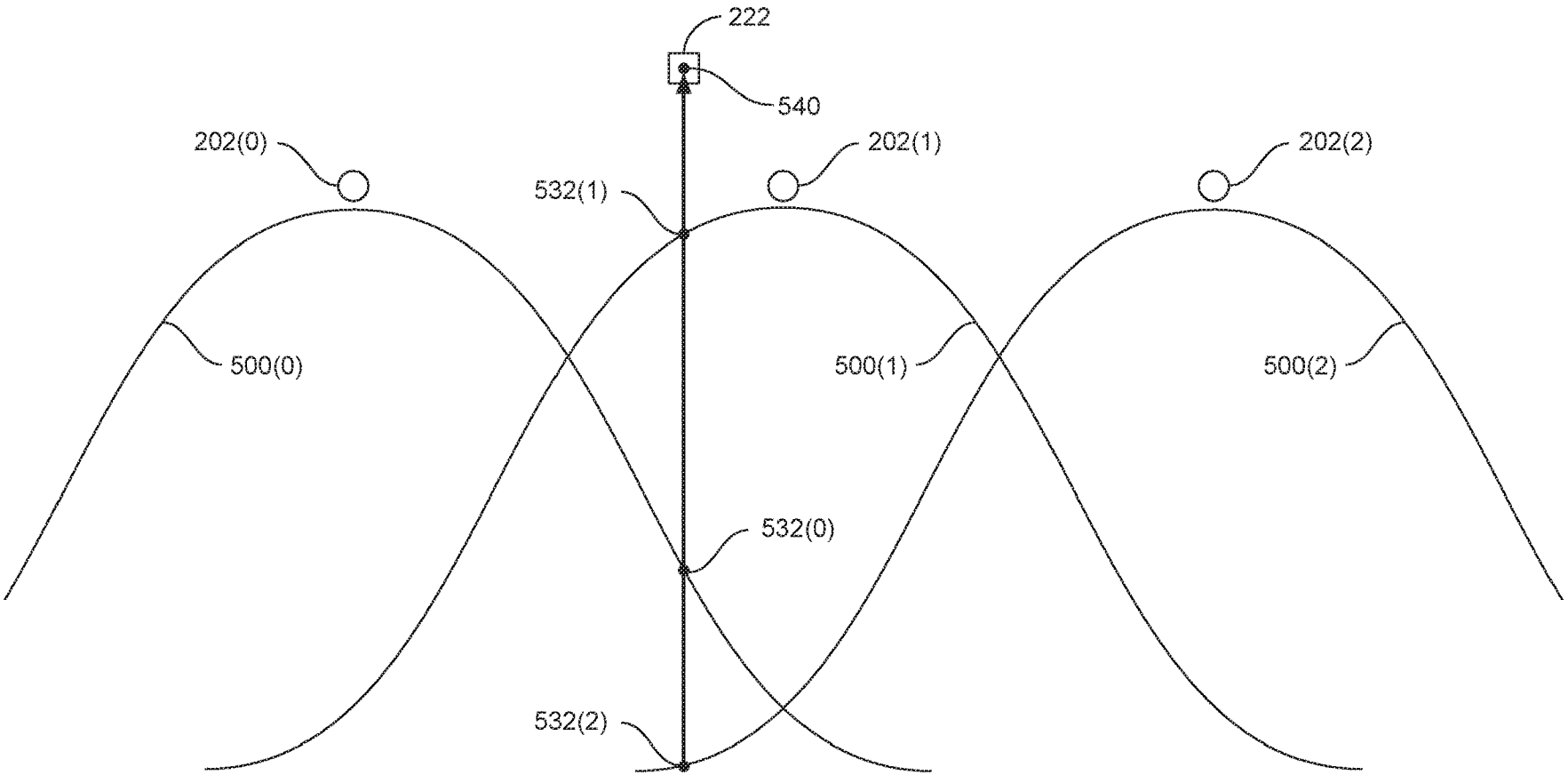

As shown in FIG. 5E, display controller 114 generates approximate contributions 532(0) and 532(2). In so doing, display controller 114 performs a similar process relative to LEDs 202(0) and 202(1) as that described above in conjunction with FIGS. 5A-5D relative to LED 202(1). Approximate contributions 532(0) and 532(2) are high precision estimates of contribution values 502(0) and 502(2), respectively. Display controller 114 combines approximate contributions 532(0), 532(1), and 532(2) to generate a BLIF value 540 that is included in BLIF 430 and corresponds to LCD pixel 222.

Referring generally to FIGS. 5A-5E, although the PSFs and approximations thereof are illustrated in two dimensions, persons skilled in the art will understand how the techniques described above can be adapted to three dimensions. In practice, the PSF LUTs described above define three-dimensional PSFs. However, because these three-dimensional PSFs are horizontally and vertically symmetric, just one quadrant of PSF data needs to be stored, thereby conserving storage space.

As general matter, display controller 114 can perform the techniques described above with any number of LEDs 202 positioned and/or arranged in any technically feasible configuration to generate a BLIF value for a given LCD pixel 222. For example, display controller 114 could generate a BLIF value for a given LCD pixel 222 by approximating the luminance contributions from LEDs 202 within a 5×5 neighborhood of LEDs around the given LCD pixel. In practice, display controller 114 implements two separate neighborhoods of LEDs when approximating luminance contributions, as described in greater detail below in conjunction with FIG. 6.

Generating PSF Samples Based on Neighborhoods of LEDs

Figure 6:
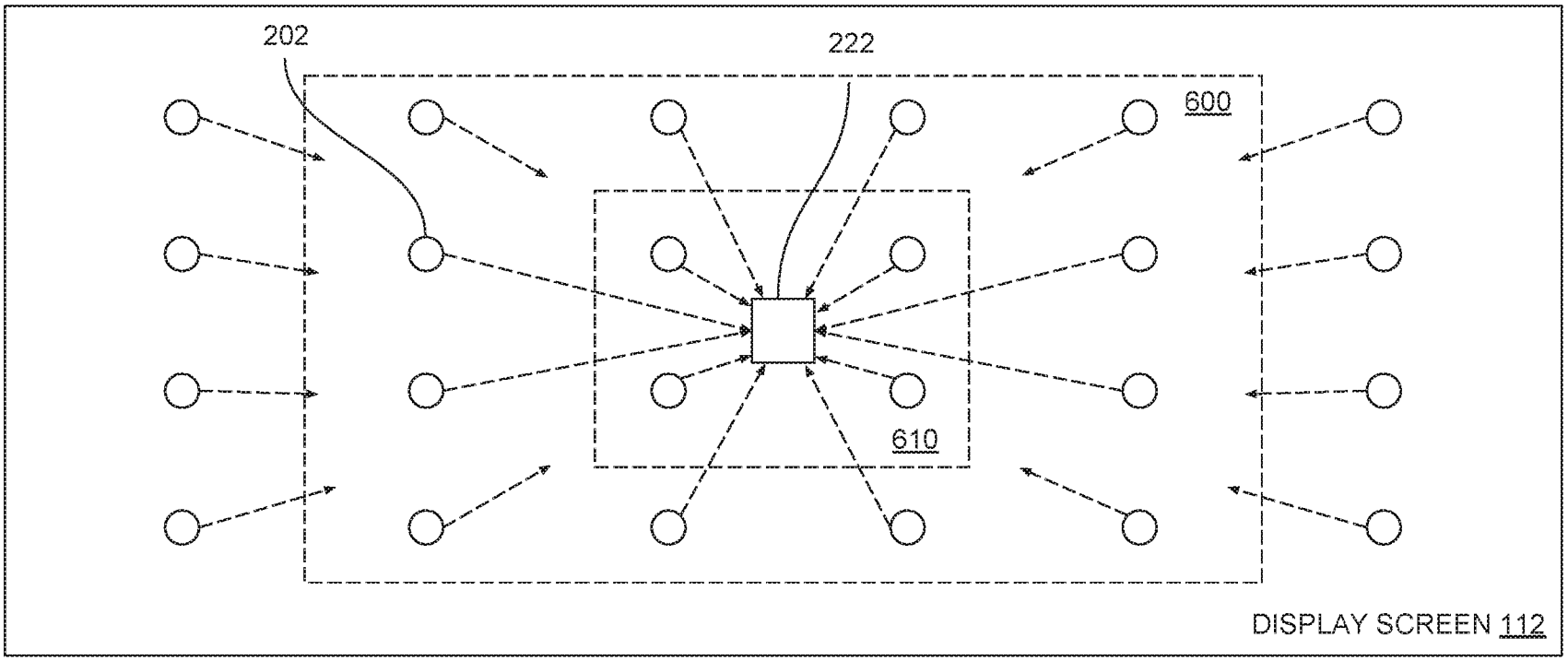
FIG. 6 illustrates how the display controller of FIG. 1 accumulates luminance contributions from different neighborhoods of LEDs, according to various embodiments of the present invention.

FIG. 6 illustrates how the display controller of FIG. 1 accumulates luminance contributions from different neighborhoods of LEDs, according to various embodiments of the present invention. As shown, display screen 112 includes a coarse neighborhood 600 and a correction neighborhood 610 surrounding LCD pixel 222. When approximating the luminance contribution to LCD pixel 222 from a given LED 202, display controller 114 generates an approximate contribution 532 for the given LED 202 in a manner that depends on the particular neighborhood to which that LED belongs.

More specifically, display controller 114 generates approximate contributions 532 for LEDs 202 that reside in coarse neighborhood 600 based only on samples drawn from coarse PSF LUT 440. Because LEDs 202 included in coarse neighborhood 600 are relatively far away from LCD pixel 222, the luminance contributions from these LEDs 202 vary approximately linearly with distance. Accordingly, the luminance contributions at LCD pixel 222 may be adequately modeled with coarse PSF LUT 440 alone.

Conversely, display controller 114 generates approximate contributions 532 for LEDs 202 that reside in correction neighborhood 610 based on samples drawn from coarse PSF LUT 440 as well as samples drawn from PSF LUT 450. Because LEDs 202 included in correction neighborhood 610 are relatively close to LCD pixel 222, the luminance contributions from these LEDs 202 vary non-linearly. Accordingly, the luminance contributions at LCD pixel 222 may need to be corrected based on samples drawn from correction PSF LUT 540.

As a general matter, the particular sizes of coarse neighborhood 600 and correction neighborhood 610 can be determined in a manner that achieves a specific accuracy for approximate contributions 532. In one embodiment, display controller 114 only implements one of the two neighborhoods shown. In another embodiment, display controller implements three or more neighborhoods and generates approximate contributions 532 for the LEDs 202 within each neighborhood based on a different combination of samples drawn from three or more PSF LUTs. In yet another embodiment, display controller 114 generates approximate contributions 532 in a manner that accounts for reflections caused by LEDs 202 that reside at or near an edge of display screen 112. This particular embodiment is described below in conjunction with FIG. 7.

Compensating for Edge Reflections with Simulated LEDs

Figure 7:
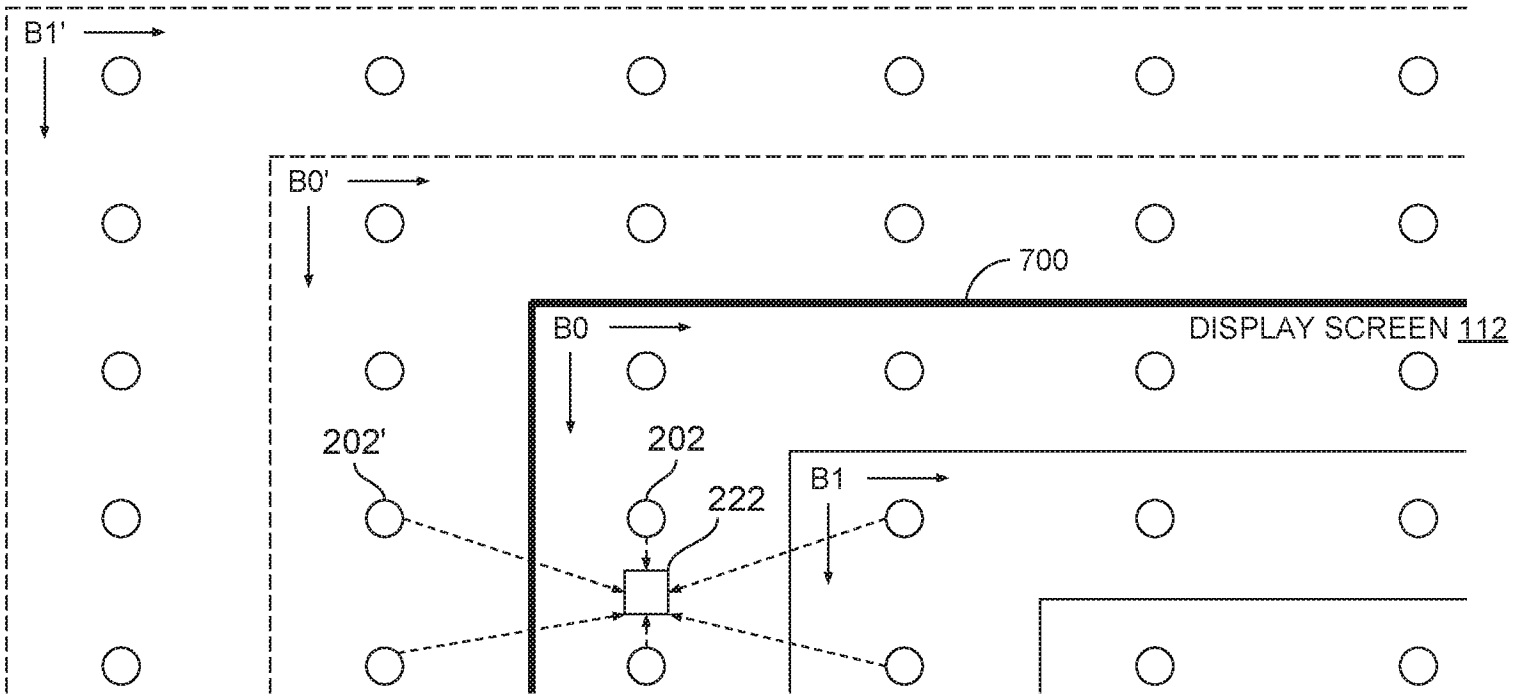
FIG. 7 illustrates how the display controller of FIG. 1 accumulates reflected luminance contributions from LEDs that reside close to a reflective surface, according to various embodiments of the present invention.

FIG. 7 illustrates how the display controller of FIG. 1 accumulates reflected luminance contributions from LEDs that reside close to a reflective surface, according to various embodiments of the present invention. As shown, display screen 112 includes an edge 700 that surrounds LEDs 202 included in display screen 112. Edge 700 includes a reflective surface (not shown) that reflects light emitted by LEDs 202. LEDs 202 are arranged into border regions B0 and B1. An LCD pixel 222 residing within a border region B0 or B1 receives an additional luminance contribution derived from light reflected by the reflective surface within edge 700. Display controller 114 accounts for this additional luminance contribution via simulated border regions B0' and B1'.

Simulated border regions B0' and B1' include simulated LEDs 202' that mirror LEDs 202 included in corresponding border regions B0 and B1. When generating approximate contributions 532 for an LCD pixel 222 within border regions B0 and B1, display controller 114 also generates approximate contributions from simulated LEDs 202' included in simulated border regions B0' and B1'. Display controller 114 implements special indexing to replicate brightness settings associated with LEDs 202 when determining approximate contributions for simulated LEDs 202'. Display controller 114 also evaluates the geometry of display screen 112 in conjunction with the geometry of border regions B0' and B1' to determine various distances between simulated LEDs 202' and LCD pixel 222.

When generating approximate contributions 532 for simulated LEDs 202', display controller 114 implements a technique that differs only slightly from that described above in conjunction with FIGS. 5A-5E. In particular, display controller 114 reduces any approximate contributions 532 generated for simulated LEDs 202' to account for the reflectiveness of the reflective surface. For example, display controller 114 could reduce any approximate contributions 532 from simulated LEDs 202' to account for imperfect reflectivity of the reflective surface. An advantage of implementing simulated LEDs 202' is that BLIF 430 more accurately represents the luminance received by LCD pixels 222 that reside close to edge 700.

Referring generally to FIGS. 4-7, display controller 114 implements the above techniques via a sequence of stages arranged into at least two different pipelines. The first pipeline implements techniques related to generating coarse approximations of the PSF. The second pipeline implements techniques related to generating corrections to those coarse approximations. The various pipeline stages of display controller 114 are described below in conjunction with FIG. 8.

Parallel Pipelines for Generating BLIF Values

Figure 8:
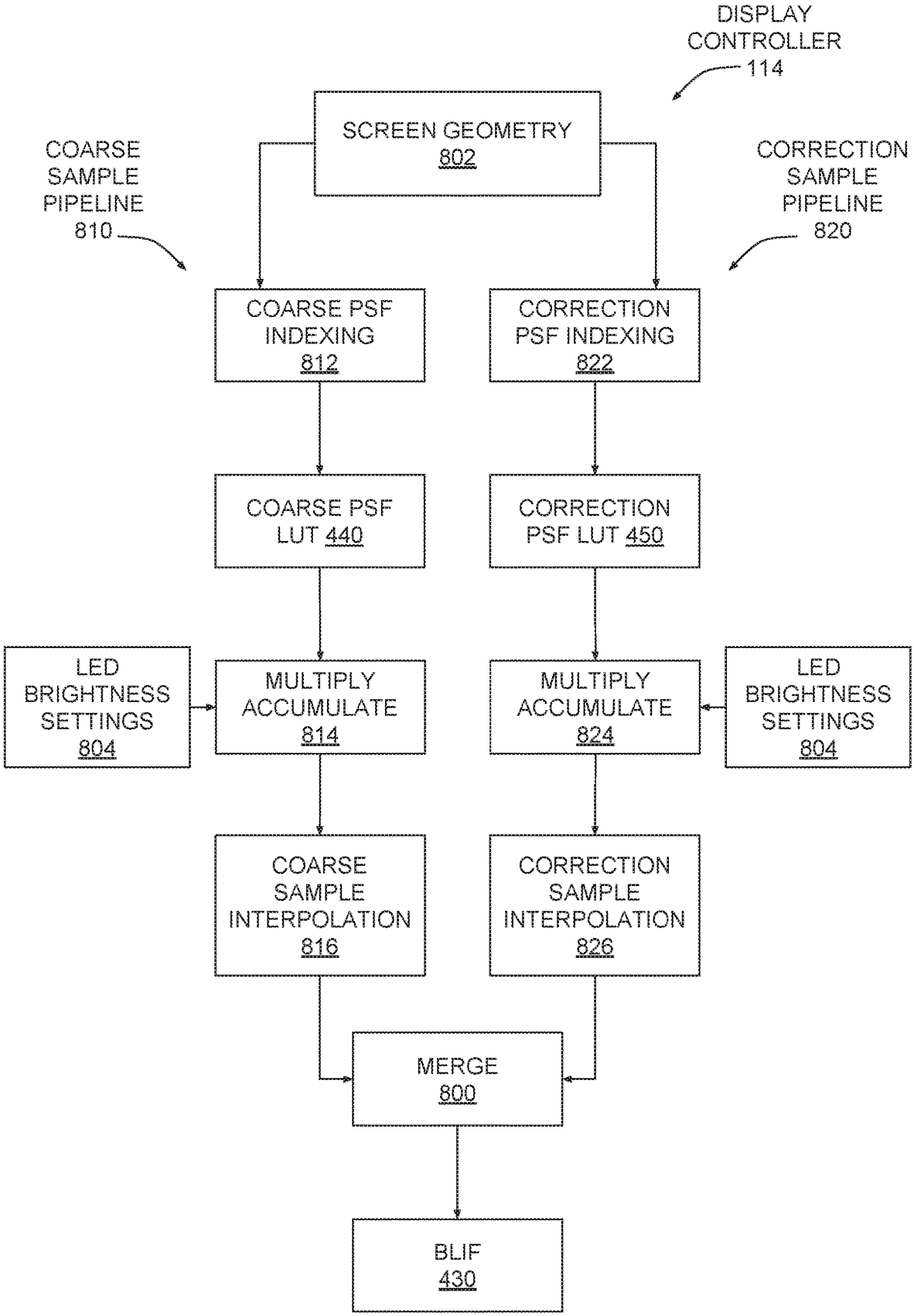
FIG. 8 is a more detailed illustration of the display controller of FIG. 1, according to various embodiments of the present invention.

FIG. 8 is a more detailed illustration of the display controller of FIG. 1, according to various embodiments of the present invention. As shown, display controller 114 includes a coarse sample pipeline 810 and a correction sample pipeline 820. Coarse sample pipeline 810 includes coarse PSF indexing 812, coarse PSF LUT 440, multiply-accumulate 814, and coarse sample interpolation 816. Correction sample pipeline 820 includes correction PSF indexing 822, correction PSF LUT 450, multiply-accumulate 824, and correction sample interpolation 826. Coarse sample pipeline 810 and correction sample pipeline 820 are both coupled to merge 800. As a general matter, coarse sample pipeline 810 and correction sample pipeline 820 operate in parallel with one another. In particular, some or all of the operations of both pipelines are performed at least partially simultaneously with one another, meaning that the operations overlap, at least in-part, during execution, and do not depend on one another to complete.

Coarse sample pipeline 810 generally performs the operations described above in conjunction with FIGS. 5B and 5D relative to a given LCD pixel 222. In doing so, coarse PSF indexing 802 analyzes screen geometry 802 to determine distances from the given LCD pixel 222 to a set of LEDs 202. The set of LEDs 202 generally includes those LEDs 202 that reside within coarse neighborhood 600 around LCD pixel 222, as shown in FIG. 6. In one embodiment, screen geometry 802 includes a look-up table indicating a distance between each LED 202 and each LCD pixel 222 included in display screen 114.

Based on the generated indices, coarse PSF LUT 440 outputs a set of coarse samples indicating luminance contributions provided to the given LCD pixel 222 by the set of LEDs 202. In one embodiment, coarse PSF LUT 440 rounds distance values associated with the generated indices according to the resolution of coarse PSF LUT 440. Each coarse sample is generally defined relative to a baseline LED brightness setting and needs to be scaled according to an actual brightness setting of a corresponding LED 202. LED brightness settings 804 include the current brightness settings for each LED 202. Multiply-accumulate 814 multiplies each coarse sample by a scaling factor that is derived from the brightness setting 804 of the corresponding LED 202 to generate a set of scaled coarse samples. For example, multiply-accumulate 814 could generate samples 512 shown in FIG. 5B.

Coarse sample interpolation 816 performs a linear interpolation operation with the scaled coarse samples to generate a set of interpolated coarse samples associated with the set of LEDs 202. The interpolated coarse samples could include, for example, interpolated sample 514 that resides along coarse curve 510, as shown in FIG. 5D. Coarse sample interpolation 816 provides the interpolated coarse samples to merge 800. In parallel with the above-described operations, correction sample pipeline 820 performs an analogous set of operations.

Correction sample pipeline 820 generally performs the operations described above in conjunction with FIGS. 5C and 5D relative to the LCD pixel 222 that is also processed via coarse sample pipeline 520. In doing so, correction PSF indexing 822 analyzes screen geometry 802 to determine distances from the given LCD pixel 222 to a set of LEDs 202. The set of LEDs 202 generally includes those LEDs 202 that reside within correction neighborhood 610 around LCD pixel 222, as shown in FIG. 6, Based on the generated indices, correction PSF LUT 450 outputs a set of correction samples. In one embodiment, correction PSF LUT 450 rounds distance values associated with the indices according to the resolution of correction PSF LUT 450. Multiply-accumulate 814 multiplies each correction sample by a scaling factor that is derived from the brightness setting 804 of the corresponding LED 202 to generate a set of scaled correction samples. For example, multiply-accumulate 824 could generate samples 522 shown in FIG. 5C. Correction sample interpolation 826 performs a linear interpolation operation to generate a set of interpolated correction samples associated with the set of LEDs 202. The interpolated correction samples could include, for example, interpolated sample 524 that resides along correction curve 520 shown in FIG. 5C. Correction sample interpolation 826 provides these interpolated correction samples to merge 800.

Merge 800 receives interpolated coarse samples from coarse sample pipeline 810 and interpolated correction samples from correction sample pipeline 820 and then adds corresponding interpolated samples together, in like fashion as illustrated in FIG. 5D. In this manner, merge 800 generates approximate contributions 532 for all LEDs 202 that contribute luminance to the LCD pixel 222. For LEDs 202 residing within coarse contribution neighborhood 600, merge 800 may not combine the associated interpolated coarse samples with any interpolated correction samples because correction samples may not be needed, as described above in conjunction with FIG. 6. Merge 800 accumulates approximate contributions 532 across all LEDs 202, including simulated LEDs 202', to generate a value for BLIF 530 corresponding to LCD pixel 222. Display controller 114 repeats the above process to generate BLIF entries for the remaining LCD pixels 222, thereby generating BLIF 530 at the full resolution of display screen 112. Display controller 114 then generates pixel values for each LCD pixel 222 based on BLIF 530 in order to display image 400.

In one embodiment, display controller 114 may replicate LCD pixel values associated with LCD pixels 222 that reside alongside or close to edge 700 of display screen 112 to other LCD pixels 222 that reside alongside or close to edge 700 of display screen. This approach can be implemented to address manufacturing techniques that modify the positions of LEDs 202, potentially altering the expected number of LCD pixel rows or columns. Display controller 114 may adjust these replicated pixel values based on attenuation factor to account for distance variations between these LCD pixels 222 and LEDs 202.

Figure 9:
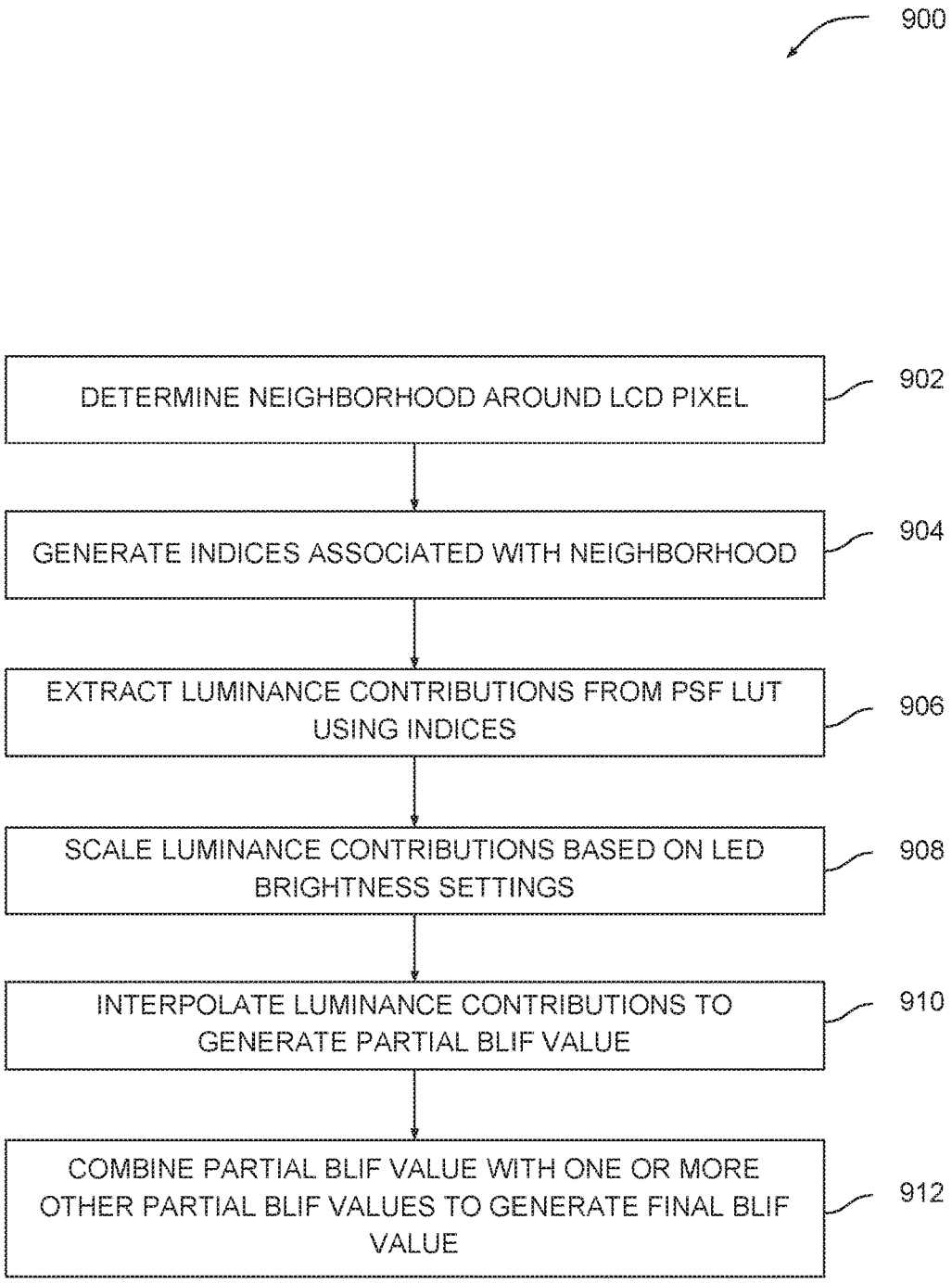
FIG. 9 is a flow diagram of method steps for generating a backlight illumination field when displaying an image, according to various embodiments of the present invention.

Advantageously, display controller 114 generates BLIF 430 at full resolution, with high accuracy, and with far fewer computations compared to conventional approaches. Because display controller 114 combines samples derived from coarse PSF LUT 440 with samples derived from correction PSF LUT 450, display controller can avoid evaluating a high-resolution PSF for each LCD pixel across all LEDs, as implemented by conventional display controllers. Thus, display controller 114 can generate BLIFs at high speed, and is therefore suitable for display devices designed for high performance applications such as gaming. As discussed, display controller 114 implements two separate pipelines when generating BLIF 430. FIG. 9 sets forth a procedure that is performed by display controller 114 when implementing either pipeline.

FIG. 9 is a flow diagram of method steps for generating a backlight illumination field when displaying an image, according to various embodiments of the present invention. Although the method steps are described in conjunction with the systems of FIGS. 1-8, persons skilled in the art will understand that any system configured to perform the method steps in any order falls within the scope of the present invention.

As shown, a method 900 begins at 902, where display controller determines a neighborhood around an LCD pixel 222. The determined neighborhood defines a region that includes LEDs 202 to be considered when accumulating luminance contributions. The neighborhood could be, for example, coarse neighborhood 600 or correction neighborhood 610. In one embodiment, display controller 114 configures neighborhood sizes to achieve a desired BLIF accuracy.

At step 904, display controller 114 generates indices associated with the neighborhood determined at step 902. Display controller 114 generates indices based on the distance between the LCD pixel 222 and each LED 202 included in the contribution neighborhood. Display controller 114 generates indices based on screen geometry 802 shown in FIG. 8.

At step 906, display controller 114 extracts luminance contributions from a PSF LUT using the indices determined at step 904. The PSF LUT could be either coarse PSF LUT 440 or correction PSF LUT 450 of FIG. 4. The PSF LUT includes luminance contributions associated with an arbitrary LED 202 as a function of distance from that LED 202. The PSF LUT could be generated, for example, by measuring different LED luminance values at different distances via an empirical process. The PSF defined by the PSF LUT is generally bell shaped, where the center of the PSF corresponds to the location of an LED.

At step 908, display controller 114 scales the luminance contributions extracted from the PSF LUT based on brightness settings associated with the LEDs 202 included in the neighborhood. The PSF LUT defines luminance contributions relative to a baseline LED brightness setting. Accordingly, these contributions need to be scaled up based on the actual brightness settings of corresponding LEDs 202. In one embodiment, display controller 114 may perform step 908 via one or more multiply-accumulate operations.

At step 910, display controller 114 interpolates the scaled luminance contributions generated at step 908 to generate a partial BLIF value. The partial BLIF value could be one of interpolated samples 514 or 524 shown in FIG. 5D, for example. At step 912, display controller 114 combines the partial BLIF value generated at step 910 with one or more other partial BLIF values to generate a final BLIF value. The other partial BLIF value can also be generated via steps 902, 904, 906, 908, and 910. The final BLIF value represents the estimated luminance at the LCD pixel 222. Display controller 114 may repeat the method 900 for each LCD pixel 222 within display screen 112 to generate a separate BLIF value for each LCD pixel 222, thereby generating BLIF 430 at the full resolution of display screen 112.

In sum, a display controller generates a BLIF based on a coarse PSF and a correction PSF. The display controller samples the coarse PSF to accumulate light contributions from a larger neighborhood of LEDs around a given LCD pixel. The display controller samples the correction PSF to generate correction factors for a smaller neighborhood of LEDs around the given LCD pixel. The display controller interpolates samples drawn from the coarse PSF and samples drawn from the correction PSF and then combines the interpolated samples to generate a full resolution BLIF.

At least one technological advantage of the disclosed techniques is that the display controller generates a full resolution BLIF with high accuracy and with far fewer computations compared to conventional approaches. Because fewer computations are needed, the disclosed display controller can generate BLIFs much faster than conventional display controllers. The disclosed display controller can therefore support high resolution display devices that include densely populated backlights and operate with high refresh rates. Accordingly, the disclosed display controller is especially useful for display devices designed for gaming and other high performance applications. For these reasons, the disclosed techniques represent a significant technological advancement compared to previous approaches.

1. Some embodiments include a computer-implemented method for displaying an image, the method comprising generating a first sample associated with a first light source based on a first dataset, wherein the first dataset includes a first plurality of luminance values indexed by a first set of distances, generating a second sample associated with the first light source based on a second dataset, wherein the second dataset includes a second plurality of luminance values indexed by a second set of distances, combining the first sample with the second sample to determine a first luminance value associated with light that is contributed to a first screen pixel by the first light source, and configuring the first screen pixel to output light associated with a first portion of the image based on the first luminance value.

2. The computer-implemented method of clause 1, further comprising determining a first distance between the first light source and the first screen pixel based on geometry data associated with a display screen that includes the first light source and the first screen pixel.

3. The computer-implemented method of any of clauses 1-2, wherein generating the first sample comprises extracting a first subset of luminance samples from the first dataset based on the first distance, and wherein generating the second sample comprises extracting a second subset of luminance samples from the second dataset based on the first distance.

4. The computer-implemented method of any of clauses 1-3, wherein generating the first sample further comprises scaling the first subset of luminance samples based on a brightness setting associated with the first light source, and wherein generating the second sample further comprises scaling the second subset of luminance samples based on a brightness setting associated with the first light source.

5. The computer-implemented method of any of clauses 1-4, wherein generating the first sample further comprises interpolating between at least two samples included in the first subset of samples to generate a first interpolated sample, and wherein generating the second sample further comprises interpolating between at least two samples included in the second subset of samples to generate a second interpolated sample.

6. The computer-implemented method of any of clauses 1-5, wherein combining the first sample with the second sample comprises adding a first interpolated sample to a second interpolated sample to generate the first luminance value.

7. The computer-implemented method of any of clauses 1-6, wherein the first data set defines a coarse approximation of a point-spread function associated with the first light source, and wherein the second data set defines a set of correction factors for refining the coarse approximation of the point-spread function.

8. The computer-implemented method of any of clauses 1-7, wherein the first sample and the second sample are generated at least partially in parallel with one another.

9. The computer-implemented method of any of clauses 1-8, wherein the first data set includes M samples, the second data set includes N samples, N and M are integer values, and N is greater than M.

10. The computer-implemented method of any of clauses 1-9, further comprising determining that the first light source resides outside of a boundary that surrounds a second screen pixel, determining a first distance between the first light source and the second screen pixel, generating a third sample associated with the first light source based on the first data set, determining a second luminance value associated with light that is contributed to the second screen pixel by the first light source based on the third sample, and configuring the second screen pixel to output light associated with a second portion of the image based on the second luminance value.

11. Some embodiments include a display device, comprising a display screen, and a display controller that causes the display screen to display an image by performing the steps of generating a first sample associated with a first light source based on a first dataset, wherein the first dataset includes a first plurality of luminance values indexed by a first set of distances, generating a second sample associated with the first light source based on a second dataset, wherein the second dataset includes a second plurality of luminance values indexed by a second set of distances, combining the first sample with the second sample to determine a first luminance value associated with light that is contributed to a first screen pixel by the first light source, and configuring the first screen pixel to output light associated with a first portion of the image based on the first luminance value.

12. The display device of clause 11, wherein the display controller performs the additional step of determining a first distance between the first light source and the first screen pixel based on geometry data associated with the display screen, wherein the display screen includes the first light source and the first screen pixel.

13. The display device of any of clauses 11-12, wherein the display controller performs the step of generating the first sample by extracting a first subset of luminance samples from the first dataset based on the first distance, wherein the display controller performs the step of generating the second sample by extracting a second subset of luminance samples from the second dataset based on the first distance, and wherein the first subset of luminance samples and the second subset of luminance samples are extracted at least partially in parallel with one another.

14. The display device of any of clauses 11-13, wherein the display controller further performs the step of generating the first sample by scaling the first subset of luminance samples based on a brightness setting associated with the first light source, wherein the display controller further performs the step of generating the second sample by scaling the second subset of luminance samples based on a brightness setting associated with the first light source, and wherein the first sample and the second sample are generated at least partially in parallel with one another.

15. The display device of any of clauses 11-14, wherein the display controller further performs the step of generating the first sample by interpolating between at least two samples included in the first subset of samples to generate a first interpolated sample, wherein the display controller further performs the step of generating the second sample by interpolating between at least two samples included in the second subset of samples to generate a second interpolated sample, and wherein the first interpolated sample and the second interpolated sample are generated at least partially in parallel with one another.

16. The display device of any of clauses 11-15, wherein the display controller performs the step of combining the first sample with the second sample by adding a first interpolated sample to a second interpolated sample to generate the first luminance value.

17. The display device of any of clauses 11-16, wherein the first data set defines a coarse approximation of a point-spread function associated with the first light source and includes M samples, wherein the second data set defines a set of correction factors for refining the coarse approximation of the point-spread function and includes N samples, and wherein M and N comprise different integer values.

18. The display device of any of clauses 11-17, wherein the display controller performs the additional steps of determining that the first light source resides outside of a boundary that surrounds a second screen pixel, determining a first distance between the first light source and the second screen pixel, generating a third sample associated with the first light source based on the first data set, determining a second luminance value associated with light that is contributed to the second screen pixel by the first light source based on the third sample, and configuring the second screen pixel to output light associated with a second portion of the image based on the second luminance value.

19. The display device of any of clauses 11-18, wherein the display controller performs the additional steps of generating a third sample associated with a simulated version of the first light source based on the first dataset, generating a fourth sample associated with the simulated version of the first light source based on the second dataset, combining the third sample with the fourth sample to determine a second luminance value associated with light that is reflected to the first screen pixel by an edge of the display screen and derived from the first light source, and configuring the first screen pixel to output light associated with the first portion of the image based further on the second luminance value.

20. Some embodiments include a subsystem for displaying an image, the subsystem comprising a first sample pipeline that generates a first sample associated with a first light source based on a first dataset, wherein the first dataset includes a first plurality of luminance values indexed by a first set of distances, a second sample pipeline that operates in parallel with the first sample pipeline to generate a second sample associated with the first light source based on a second dataset, wherein the second dataset includes a second plurality of luminance values indexed by a second set of distances, a combiner that is coupled to the first sample pipeline and to the second sample pipeline and that combines the first sample with the second sample to determine a first luminance value associated with light that is contributed to a first screen pixel by the first light source, wherein the first screen pixel outputs light associated with a first portion of the image based on the first luminance value.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system" Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for displaying an image, the method comprising:

generating a first sample associated with a first light source based on a first dataset, wherein the first dataset includes a first plurality of luminance values indexed by a first set of distances;

generating a second sample associated with the first light source based on a second dataset, wherein the second dataset includes a second plurality of luminance values indexed by a second set of distances;

combining the first sample with the second sample to determine a first luminance value associated with light that is contributed to a first screen pixel by the first light source; and configuring the first screen pixel to output light associated with a first portion of the image based on the first luminance value.

2. The computer-implemented method of claim 1, further comprising determining a first distance between the first light source and the first screen pixel based on geometry data associated with a display screen that includes the first light source and the first screen pixel.

3. The computer-implemented method of claim 2, wherein generating the first sample comprises extracting a first subset of luminance samples from the first dataset based on the first distance, and wherein generating the second sample comprises extracting a second subset of luminance samples from the second dataset based on the first distance.

4. The computer-implemented method of claim 3, wherein generating the first sample further comprises scaling the first subset of luminance samples based on a brightness setting associated with the first light source, and wherein generating the second sample further comprises scaling the second subset of luminance samples based on a brightness setting associated with the first light source.

5. The computer-implemented method of claim 3, wherein generating the first sample further comprises interpolating between at least two samples included in the first subset of luminance samples to generate a first interpolated sample, and wherein generating the second sample further comprises interpolating between at least two samples included in the second subset of luminance samples to generate a second interpolated sample.

6. The computer-implemented method of claim 1, wherein combining the first sample with the second sample comprises adding a first interpolated sample to a second interpolated sample to generate the first luminance value.

7. The computer-implemented method of claim 1, wherein the first dataset defines a coarse approximation of a point-spread function associated with the first light source, and wherein the second dataset defines a set of correction factors for refining the coarse approximation of the point-spread function.

8. The computer-implemented method of claim 1, wherein the first sample and the second sample are generated at least partially in parallel with one another.

9. The computer-implemented method of claim 1, wherein the first dataset includes M samples, the second dataset includes N samples, N and M are integer values, and N is greater than M.

10. The computer-implemented method of claim 1, further comprising:

determining that the first light source resides outside of a boundary that surrounds a second screen pixel;

determining a first distance between the first light source and the second screen pixel;

generating a third sample associated with the first light source based on the first dataset;

determining a second luminance value associated with light that is contributed to the second screen pixel by the first light source based on the third sample; and configuring the second screen pixel to output light associated with a second portion of the image based on the second luminance value.

11. A display device, comprising:

a display screen; and a display controller that causes the display screen to display an image by performing the steps of:

generating a first sample associated with a first light source based on a first dataset, wherein the first dataset includes a first plurality of luminance values indexed by a first set of distances, generating a second sample associated with the first light source based on a second dataset, wherein the second dataset includes a second plurality of luminance values indexed by a second set of distances, combining the first sample with the second sample to determine a first luminance value associated with light that is contributed to a first screen pixel by the first light source, and configuring the first screen pixel to output light associated with a first portion of the image based on the first luminance value.

12. The display device of claim 11, wherein the display controller performs the additional step of determining a first distance between the first light source and the first screen pixel based on geometry data associated with the display screen, wherein the display screen includes the first light source and the first screen pixel.

13. The display device of claim 12, wherein the display controller performs the step of generating the first sample by extracting a first subset of luminance samples from the first dataset based on the first distance, wherein the display controller performs the step of generating the second sample by extracting a second subset of luminance samples from the second dataset based on the first distance, and wherein the first subset of luminance samples and the second subset of luminance samples are extracted at least partially in parallel with one another.

14. The display device of claim 13, wherein the display controller further performs the step of generating the first sample by scaling the first subset of luminance samples based on a brightness setting associated with the first light source, wherein the display controller further performs the step of generating the second sample by scaling the second subset of luminance samples based on a brightness setting associated with the first light source, and wherein the first sample and the second sample are generated at least partially in parallel with one another.

15. The display device of claim 13, wherein the display controller further performs the step of generating the first sample by interpolating between at least two samples included in the first subset of luminance samples to generate a first interpolated sample, wherein the display controller further performs the step of generating the second sample by interpolating between at least two samples included in the second subset of luminance samples to generate a second interpolated sample, and wherein the first interpolated sample and the second interpolated sample are generated at least partially in parallel with one another.

16. The display device of claim 11, wherein the display controller performs the step of combining the first sample with the second sample by adding a first interpolated sample to a second interpolated sample to generate the first luminance value.

17. The display device of claim 11, wherein the first data set defines a coarse approximation of a point-spread function associated with the first light source and includes M samples, wherein the second data set defines a set of correction factors for refining the coarse approximation of the point-spread function and includes N samples, and wherein M and N comprise different integer values.

18. The display device of claim 11, wherein the display controller performs the additional steps of:

determining that the first light source resides outside of a boundary that surrounds a second screen pixel;

determining a first distance between the first light source and the second screen pixel;

generating a third sample associated with the first light source based on the first dataset;

determining a second luminance value associated with light that is contributed to the second screen pixel by the first light source based on the third sample; and configuring the second screen pixel to output light associated with a second portion of the image based on the second luminance value.

19. The display device of claim 11, wherein the display controller performs the additional steps of:

generating a third sample associated with a simulated version of the first light source based on the first dataset;

generating a fourth sample associated with the simulated version of the first light source based on the second dataset;

combining the third sample with the fourth sample to determine a second luminance value associated with light that is reflected to the first screen pixel by an edge of the display screen and derived from the first light source; and configuring the first screen pixel to output light associated with the first portion of the image based further on the second luminance value.

20. A subsystem for displaying an image, the subsystem comprising:

a first sample pipeline that generates a first sample associated with a first light source based on a first dataset, wherein the first dataset includes a first plurality of luminance values indexed by a first set of distances;

a second sample pipeline that operates in parallel with the first sample pipeline to generate a second sample associated with the first light source based on a second dataset, wherein the second dataset includes a second plurality of luminance values indexed by a second set of distances;

a combiner that is coupled to the first sample pipeline and to the second sample pipeline and that combines the first sample with the second sample to determine a first luminance value associated with light that is contributed to a first screen pixel by the first light source, wherein the first screen pixel outputs light associated with a first portion of the image based on the first luminance value.

* * * * *